United States Patent [19]

Pickett

[11] 4,026,077

[45] May 31, 1977

[54] EXOSKELETAL STRUCTURE AND METHODS FOR ITS CONSTRUCTION

[76] Inventor: Edwin Charles Pickett, P.O. Box 764, Marshall, Calif. 94940

[22] Filed: June 11, 1975

[21] Appl. No.: 586,016

[52] U.S. Cl. ..... 52/80; 52/86

[51] Int. Cl.[2] ..... E04B 1/32

[58] Field of Search ..... 52/80, 81, 86

[56] References Cited

UNITED STATES PATENTS

| | | | |
|---|---|---|---|
| 2,271,451 | 1/1942 | Blaski | 52/86 |
| 2,351,121 | 6/1944 | Hart | 52/80 |
| 2,522,401 | 9/1950 | Rava | 52/80 |
| 2,897,668 | 8/1959 | Graham | 52/81 |
| 3,154,888 | 11/1964 | Graham | 52/80 |
| 3,187,852 | 6/1965 | Carman | 52/86 |
| 3,221,451 | 12/1965 | Stolz | 52/80 |
| 3,472,033 | 10/1969 | Brown | 52/80 |

FOREIGN PATENTS OR APPLICATIONS

| | | | |
|---|---|---|---|
| 774,802 | 1/1968 | Canada | 52/81 |
| 351,527 | 8/1937 | Italy | 52/80 |

*Primary Examiner*—Ernest R. Purser
*Assistant Examiner*—Henry Raduazo
*Attorney, Agent, or Firm*—Limbach, Limbach & Sutton

[57] ABSTRACT

A self-supporting structure comprised of a corrugated, convoluted, rigid surface which is elliptical in plan and elevation taken along its length and slightly in excess of semicircular when viewed from its end, the corrugations being parallel to each other and perpendicular to its length and decreasing in diameter progressively by a fixed percent taken in the direction from the middle of the structure towards its ends.

6 Claims, 27 Drawing Figures

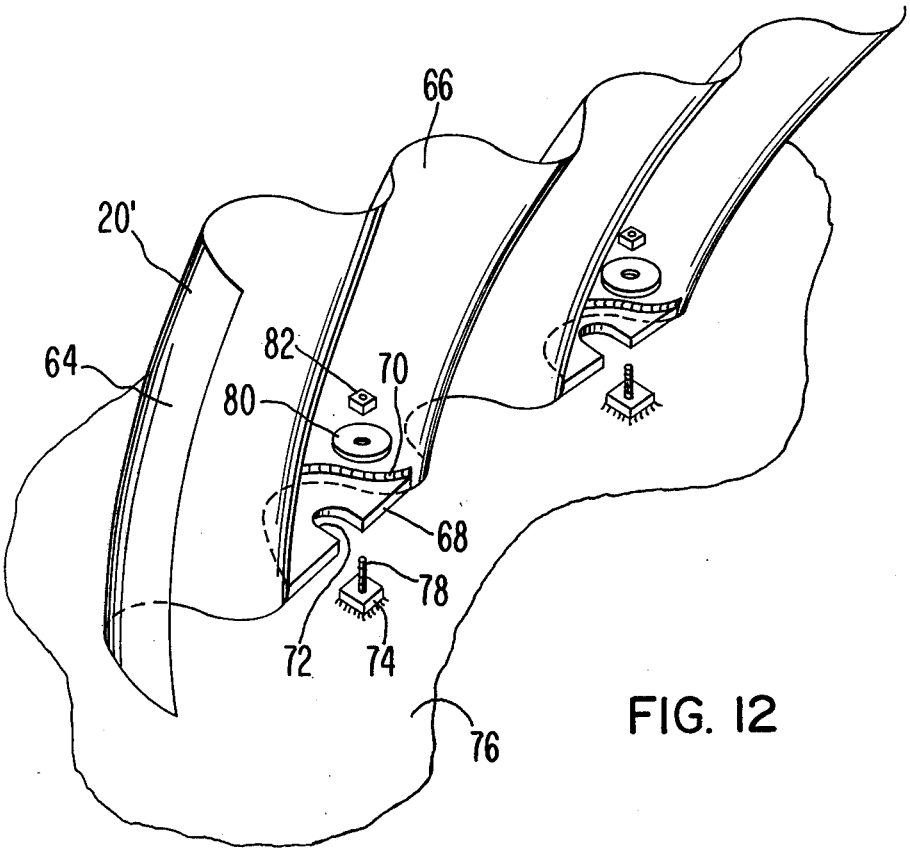
FIG. 12
FIG. 13
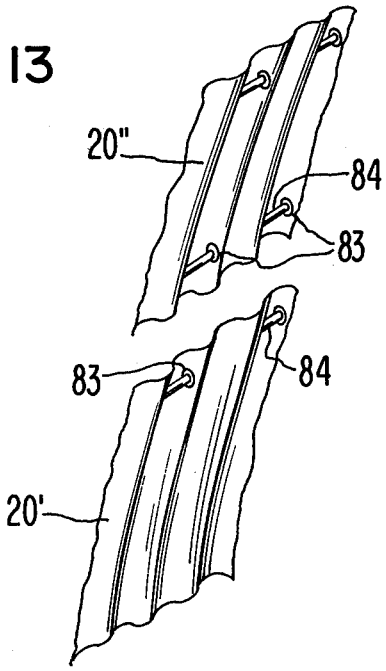
FIG. 14
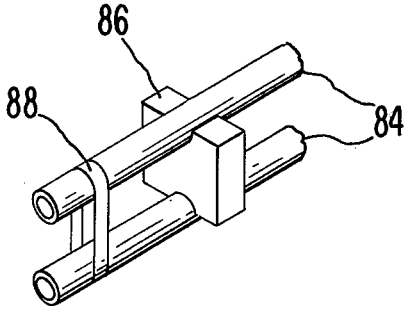

FIG. 15
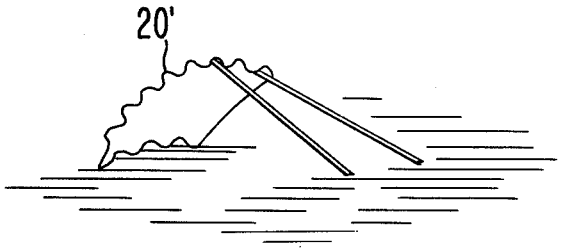
FIG. 16
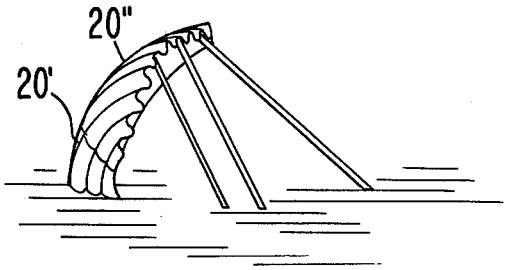
FIG. 17
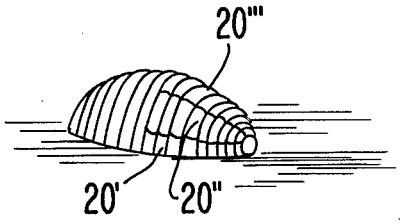
FIG. 18
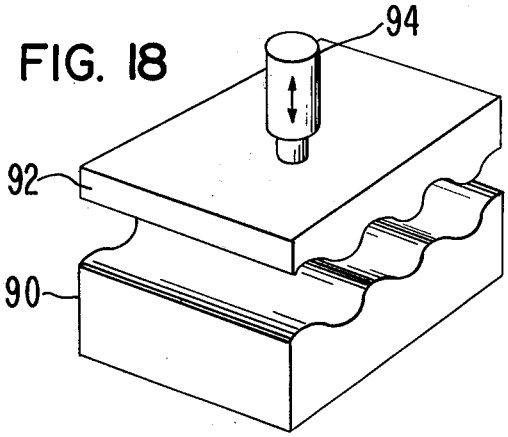
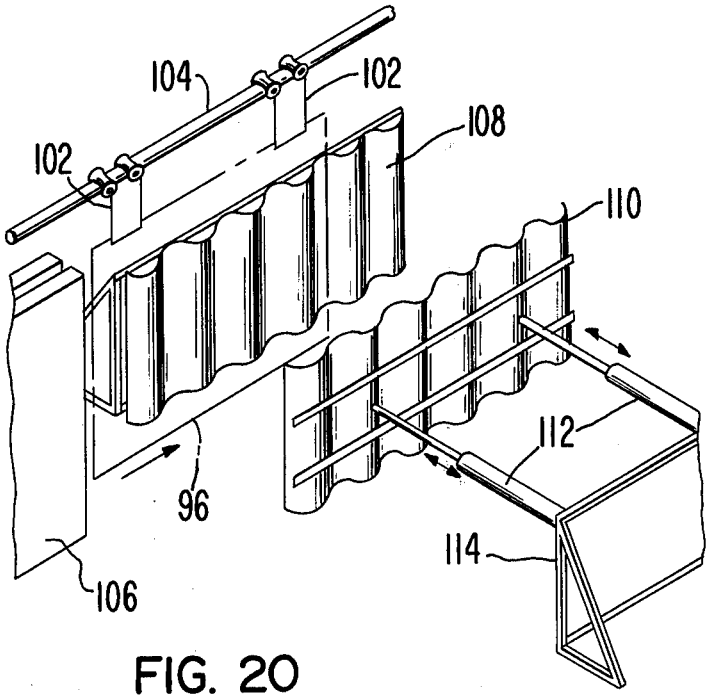
FIG. 20
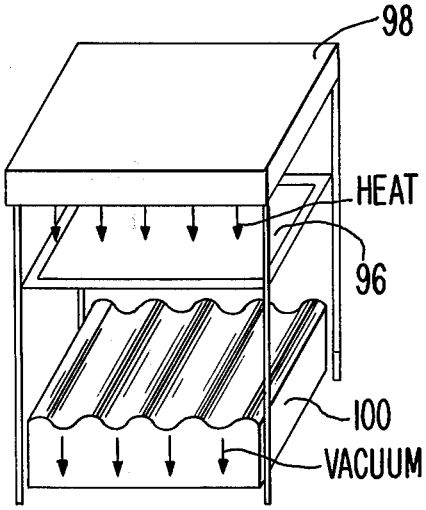
FIG. 19

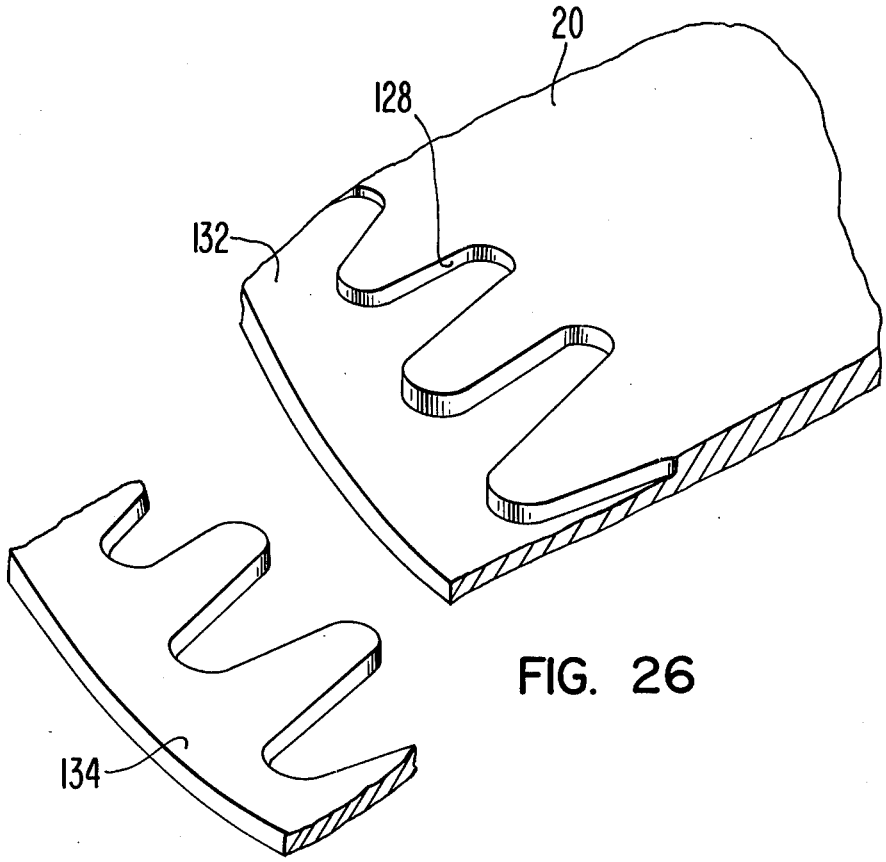
FIG. 26
FIG. 27
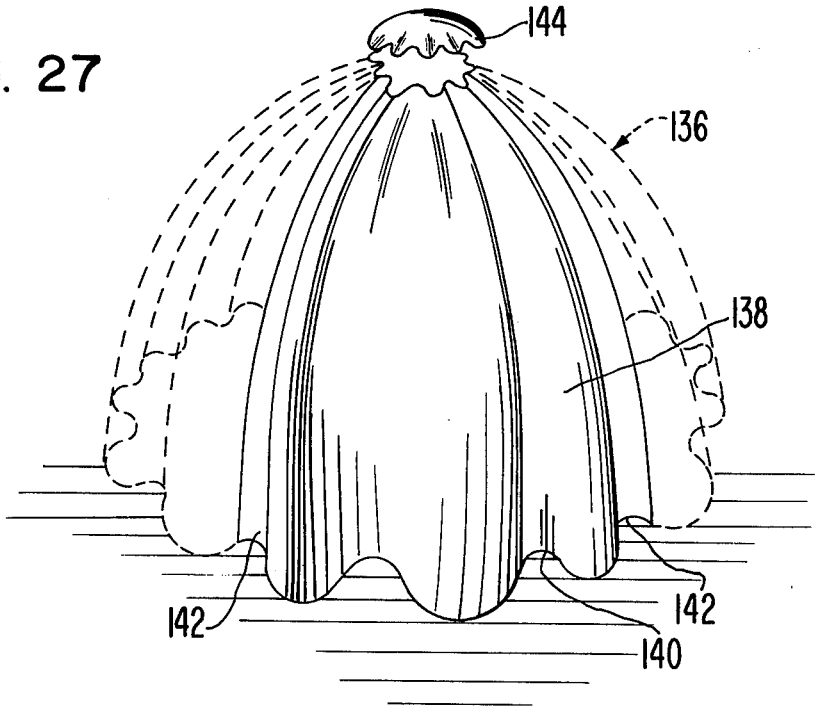

EXOSKELETAL STRUCTURE AND METHODS FOR ITS CONSTRUCTION

BACKGROUND OF THE INVENTION

This invention relates to a self-supporting structure, and more particularly to a self-supporting structure comprised of modular elements.

It is often desirable to be able to fabricate a self-supporting structure, hereinafter referred to as an exoskeletal structure because it does not have any interior supports for use as both temporary and permanent exhibition halls, environmental shelters, and the like, greenhouses or growth supporting structures, i.e., that require enclosure and yet be light transmitting. It is particularly desirable to make such structures from modular building elements which need only be fastened together along their edges. Perhaps one of the best known of such structures is a semicylindrical hut built of corrugated metal elements fastened together and popularly known by the trademark Quonset, which is owned by Stran-Steel Corporation. In other convoluted structures, particularly when made of nonmetallic materials, the surface is not corrugated but is simply made up of a series of convex convolutions. See, for example, U.S. Pat. Nos. 3,750,353 and 3,118,010.

There have been several disadvantages with such prior art type structures. They are often relatively expensive, are somewhat time-consuming to construct, and are almost uniformly unattractive. Since their primary purpose is functional, no attempt has generally been made to consider the various geometric relationships between the dimensions of such structures to produce a structure which is both functionally sound and aesthetically appealing.

SUMMARY OF THE INVENTION

The above disadvantages of the prior art are overcome and the objectives of producing an aesthetically appealing and functionally sound exoskeletal structure are achieved by the present invention of a self-supporting structure comprising a corrugated, convoluted, rigid surface which is elliptical in plan and elevation taken along its length and slightly in excess of semicircular when viewed from its end. The corrugations run parallel to each other and are perpendicular to the length of the structure. The alternate concave and convex convolutions which make up the corrugations are dimensioned such that the concave convolutions are two-thirds the diameter of the convex convolutions and the convolutions diminish in diameter progressively by a fixed percentage, which is 10 percent in the preferred embodiment, taken in the direction from the middle of the building toward its end. The convolutions are semicircular in cross-section with the center point for the semicircular curve of each convolution being offset from a hypothetical semielliptical line extending from one end of the structure to the other by an arithmetically decreasing sequence of distances beginning with the convolution which is closest to the middle of the structure.

In the preferred embodiment the surface is comprised of a plurality of rigid, identically configured elements which are rigidly attached together at their longitudinal and lateral edges. In the preferred embodiment the elements each extend from the middle of the surface to its end with each element being a half gore, or in other words, a longitudinal, half sector of the ellipsoid shaped surface.

In the preferred embodiment the method of constructing the structure includes the step of forming the plurality of rigid corrugated surface elements with each element being the longitudinal, half sector of the overall ellipsoidal surface. The elements are generally formed by molding by any of various well known techniques, such as applying a fiberglass reinforced polyester (FRP) over a mold, stamping a thermoplastic sheet, vacuum-forming a thermoplastic sheet, or by compression molding FRP for example. Although the actual embodiment was constructed using FRP the convoluted shell form is suitable and adaptable to other existing materials such as concrete, ferro cement, paper, plastic foams, etc. These rigid sections are next rigidly attached to each other along their edges to make the completed structures.

The design of the invention is intended to present a piece of sculpture with the functional aspect of being able to serve as a shelter. Although aesthetic considerations were important in the planning and building of the structure, the finished work is an integration of beautiful form and utilitarian object.

An actual embodiment of the invention was constructed. This constructed version is 30 feet long by 20 feet wide by 14 feet high and is elliptical in plan and elevation and partially circular in section. It was constructed separately in two halves, each comprising five panels taken from the same mold. The transverse convolutions give great strength to the structure.

In one embodiment of the invention the panels may be made from plastic such as butyrate or acrylic, which may be either transparent or translucent so as to provide unassisted daylight illumination of the interior. In still other embodiments the panels are formed from fiberglass which may be either colored or uncolored. The constructed embodiment utilized fiberglass approximately 3/16 inch thick and altogether the structure weighs approximately ¾ of a ton. Each of the sections weighs from 150 to 200 pounds. This weight would be greatly reduced by more advanced techniques in forming the panel section, such as by vacuum forming or any of the other thermoplastic molding techniques to be discussed in more detail hereinafter.

In addition to supplying a structural rigidity to the surface, the convolutions also give an illusion of infinite space when viewed from the inside looking towards one of the ends. The effect of this illusion is to give a perception of great length to the structure and to diminish the feeling of being surrounded by the surface. An additional advantage of the convolutions is that they provide extremely satisfactory accoustical characteristics, somewhat modifying the "whispering gallery" effect common to many elliptically domed structures. Laterally sound is transmitted quite well while longitudinally the sound is attenuated. Thus one could easily carry on a conversation at one end across the structure without disturbance from a band playing at the opposite end.

It is therefore an object of the present invention to provide an exoskeletal structure which is both functional and aesthetically pleasing;

It is another object of the invention to provide an exoskeletal structure which provides an interior illusion of infinite space;

It is still another object of the invention to provide an exoskeletal structure having a convoluted form which enables it to have a thin skin and yet be capable of spanning a very large distance;

It is a further object of the invention to provide a rigid exoskeletal structure with a minimum material thickness;

It is a still further object of the invention to provide an exoskeletal structure having no local stress points for a minimum of material used;

It is still another object of the invention to provide an exoskeletal structure having "visual rightness" and corresponding structural, accoustic, air circulating and interior spaciousness properties; and It is still another object of the invention to provide an exoskeletal structure having no interior unusable space and having standing headroom at any point within the interior.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIG. 12 is an enlarged, perspective, partially exploded view of a portion of the embodiment depicted in FIG. 1 illustrating the foundation securing apparatus of the embodiment;

FIG. 13 is a perspective, exploded view of portions of the surface elements of the embodiment depicted in FIG. 1;

FIG. 14 is an enlarged, perspective view of the means for temporarily securing the surface elements together during assembly;

FIGS. 15, 16 and 17 are perspective views showing various stages of the assembly of the embodiment depicted in FIG. 1;

FIG. 18 is a diagrammatic, perspective view of apparatus for forming the surface elements of the embodiment of FIG. 1 according to a first method;

FIG. 19 is a diagrammatic, perspective view of apparatus for forming the surface elements of the invention according to a second method;

FIG. 20 is a diagrammatic, perspective view of apparatus for forming the surface elements of the invention according to a third method;

FIGS. 22–26, inclusive, are diagrammatic views for illustrating the method for obtaining certain sections of the surface elements to make up the embodiment depicted in FIG. 21; and FIG. 27 is a perspective view of a second embodiment of the invention.

DETAILED DESCRIPTION OF CERTAIN PREFERRED EMBODIMENTS

Figure 1:
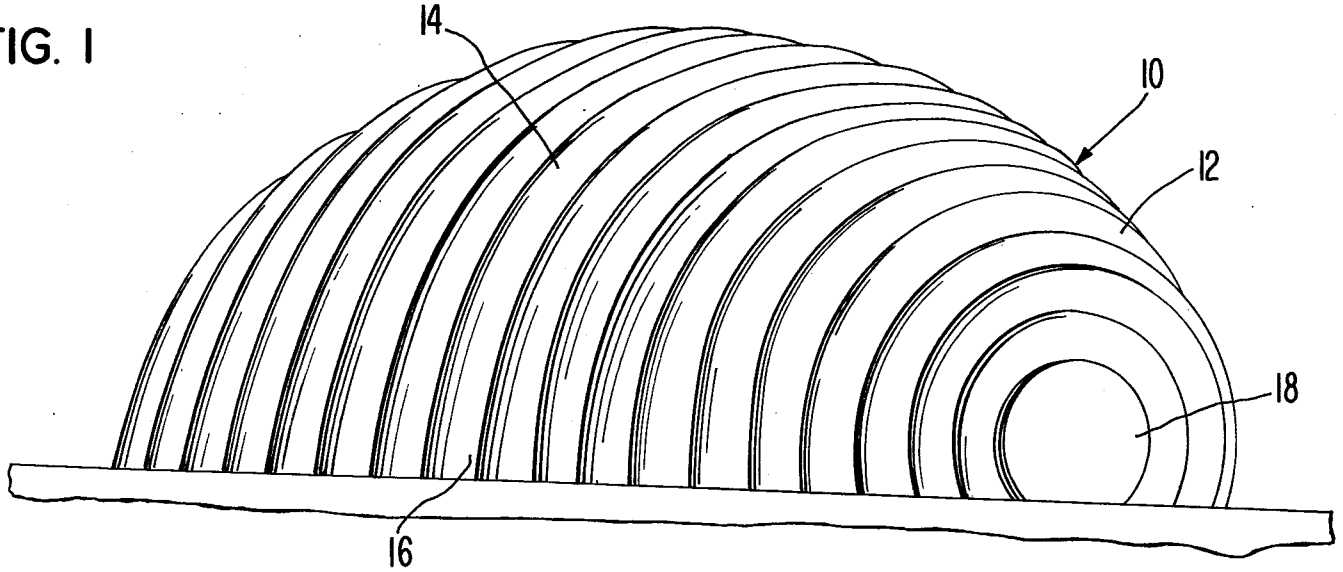
FIG. 1 is a perspective view of an exoskeletal structure according to one embodiment of the invention.
Figure 2:
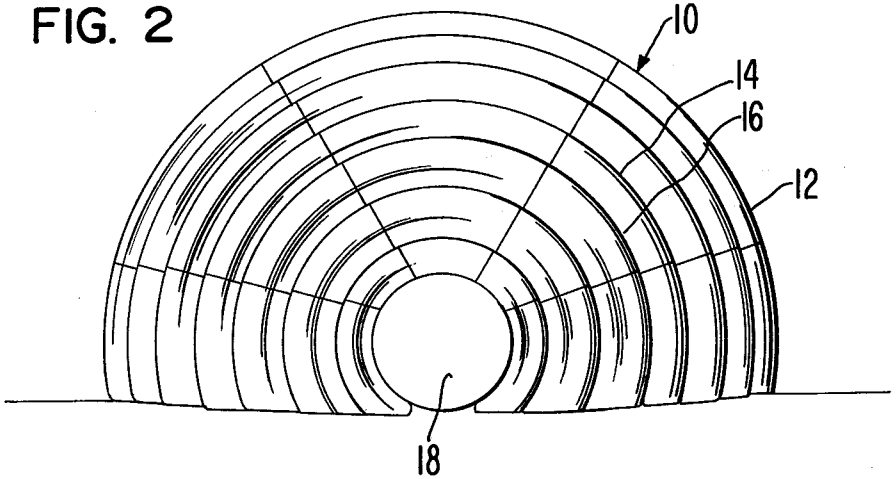
FIG. 2 is an end view in elevation of the exoskeletal structure depicted in FIG. 1.

Referring now more particularly to FIGS. 1 and 2, the exoskeletal structure 10 of the preferred embodiment of the invention is comprised of a rigid surface 10 which is elliptical in plan and elevation taken along its length and partially circular when viewed from its end (FIG. 2). The surface has a series of alternately convex and concave convolutions 14 and 16 which extend parallel to each other and laterally across the surface 12. An end cap 18 closes off at least one end of the structure which may be provided with a door (not shown) at the other end of the structure. In other embodiments, of course, the ends may both be provided with doors. The surface 12 is molded from a plastic material by any one of several methods to be described in greater detail hereinafter.

Figure 3:
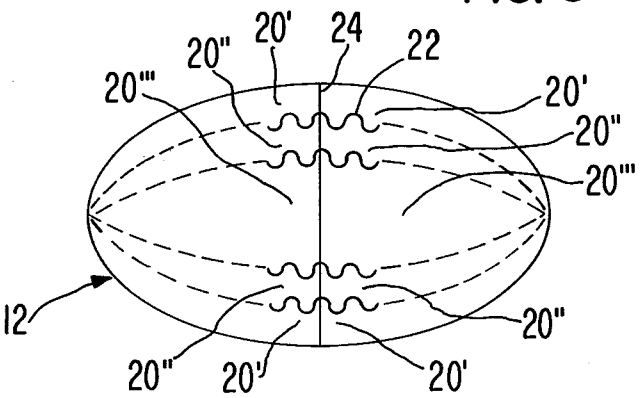
FIG. 3 is a diagrammatic plan view of the exoskeletal structure depicted in FIG. 1.

Referring now more particularly to FIG. 3, the surface 12 is comprised of a plurality of rigid, identical elements which are rigidly attached together at their edges. In particular each element 20 comprises a segment of the corrugated surface. The elements 20 are actually longitudinal, half sectors of the overall ellipsoidal surface 12. Five of the elements 20 are attached together along their longitudinal edges. Each element 20 extends from the middle of the surface 12 to one of its ends. In a particular embodiment depicted in FIG. 3, five elements 20 are attached together along their longitudinal edges 22 to form a first group and a second group of five longitudinally edge attached elements 20, making a second group, are then attached to the first group along the longer of their lateral edges 24 to make the completed structure. This assembly of the surface elements will be described in greater detail hereinafter.

Figure 4:
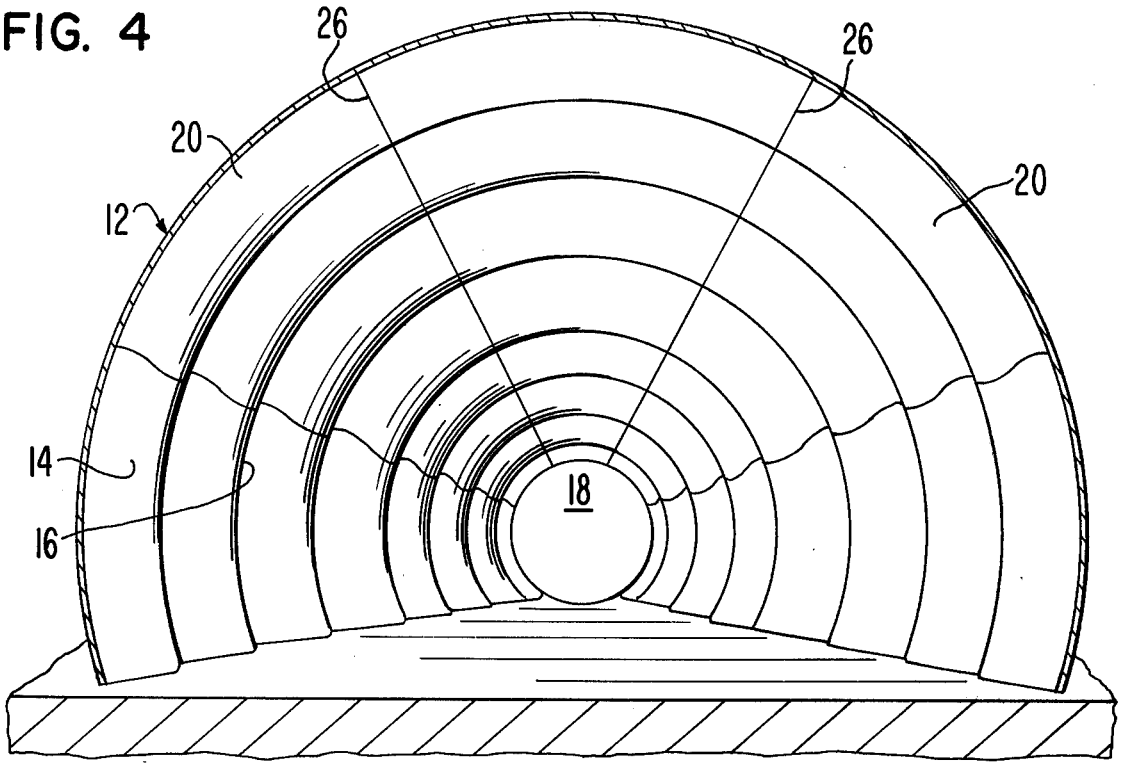
FIG. 4 is a vertical end view from the interior of the structure depicted in FIG. 1.

Referring now more particularly to FIG. 4 it will be observed that when standing inside the structure 10 and looking towards one of the end caps 18 the concave convolution 16 appears to be convex and the convex convolution 14 appears to be concave, since the viewer is now on the opposite side of the surface from the view in FIGS. 1 and 2. Also, the attachment of the elements 20 is somewhat more apparent and it can be seen that the elements 20 when attached to each other have a degree of overlap 26. This overlap will also be explained in greater detail hereinafter.

One great advantage of the design of the structure according to the invention is that the convolutions give an illusion of infinity of space. To the viewer standing inside the structure looking at the end cap 18 the interior surface of the structure 12 somewhat appears to invert itself so that it gives the illusion that one is standing outside of the structure looking at the end cap rather than standing inside. This illusion is referred to hereinafter as the infinity of space. Another effect takes place in regard to the accoustic properties of the interior of the surface 12. The surface does not have the same hollowness or echoing type of response as would a similar but smooth surface ellipsoid shell.

Figure 5:
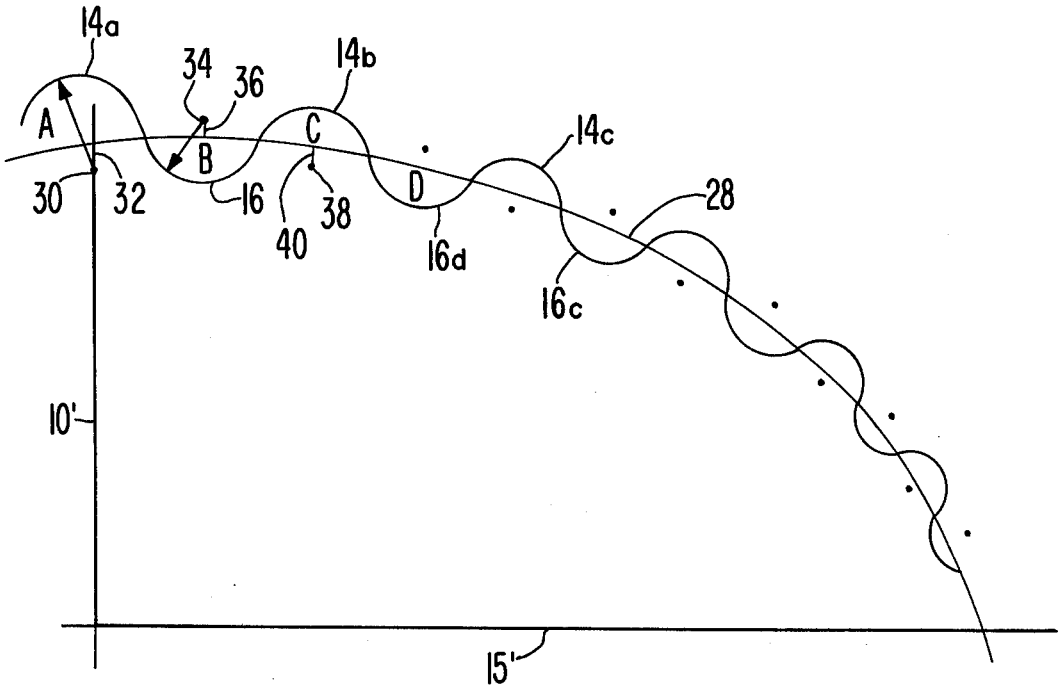
FIG. 5 is a diagrammatic longitudinal section of the embodiment depicted in FIG. 1 for use in explaining the formulation of the convolutions.
Figure 6:
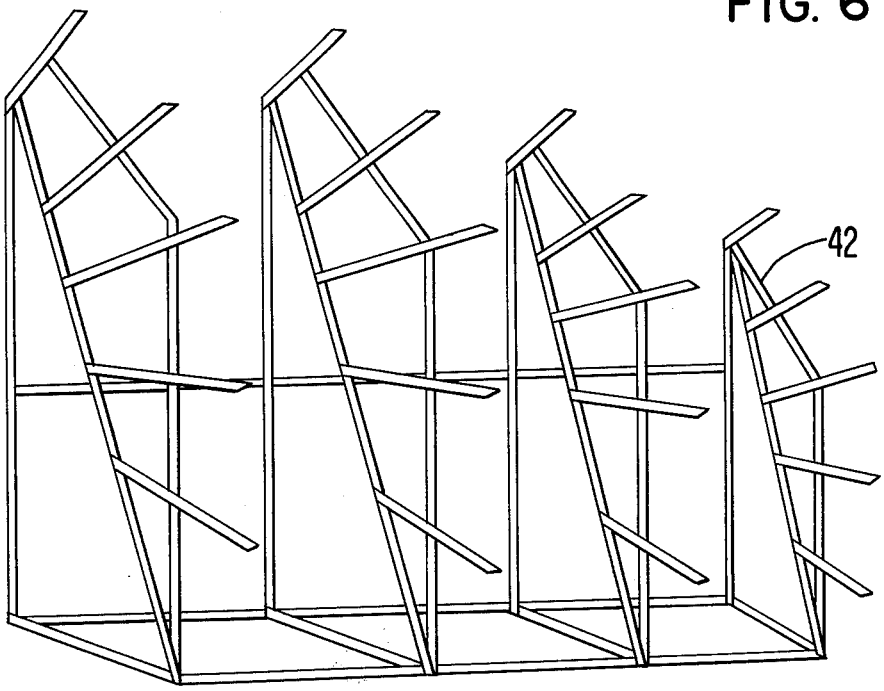
FIGS. 6 and 7 are perspective views of framing for use in constructing the mold for use in fabricating the embodiment depicted in FIG. 1.
Figure 7:
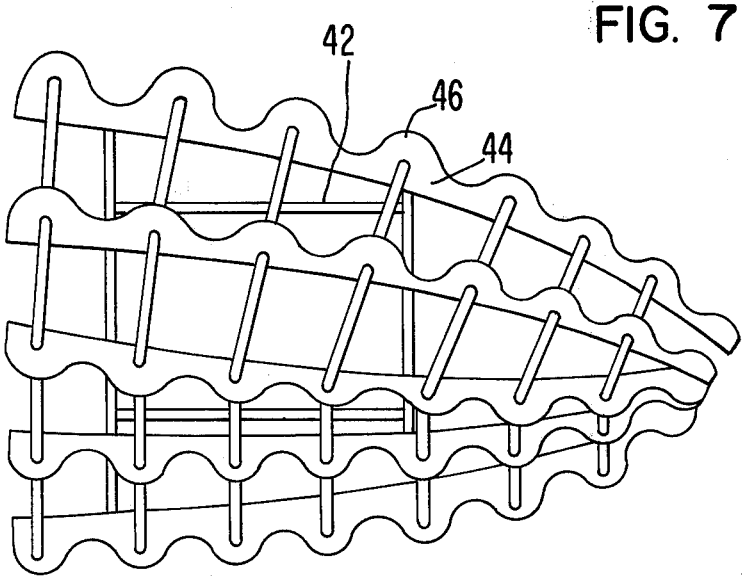
Figure 8:
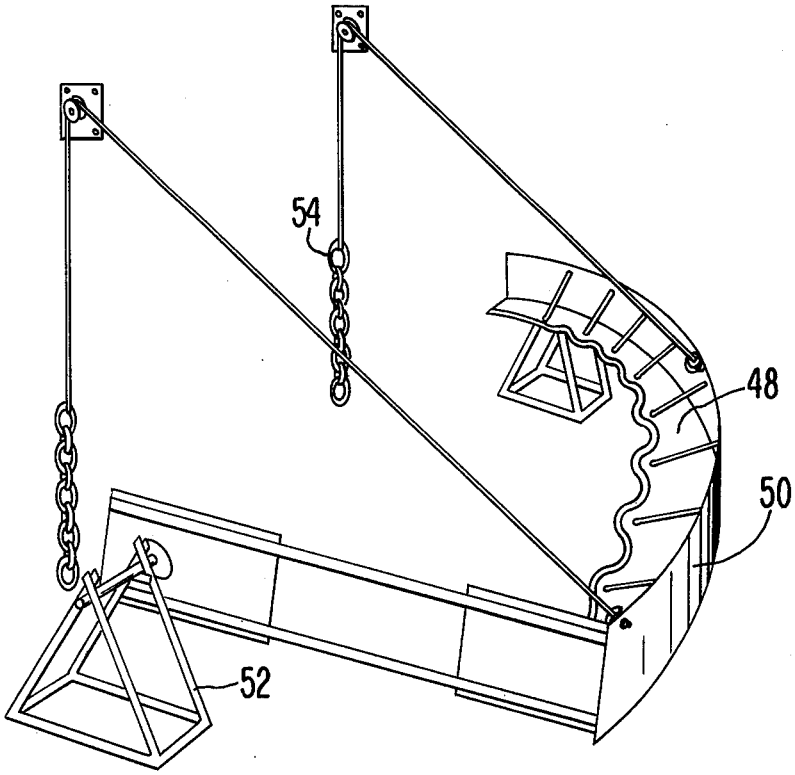
FIG. 8 is a perspective view of a rotating blade used in constructing the plug for fabricating the mold used in making the embodiment depicted in FIG. 1.
Figure 9:
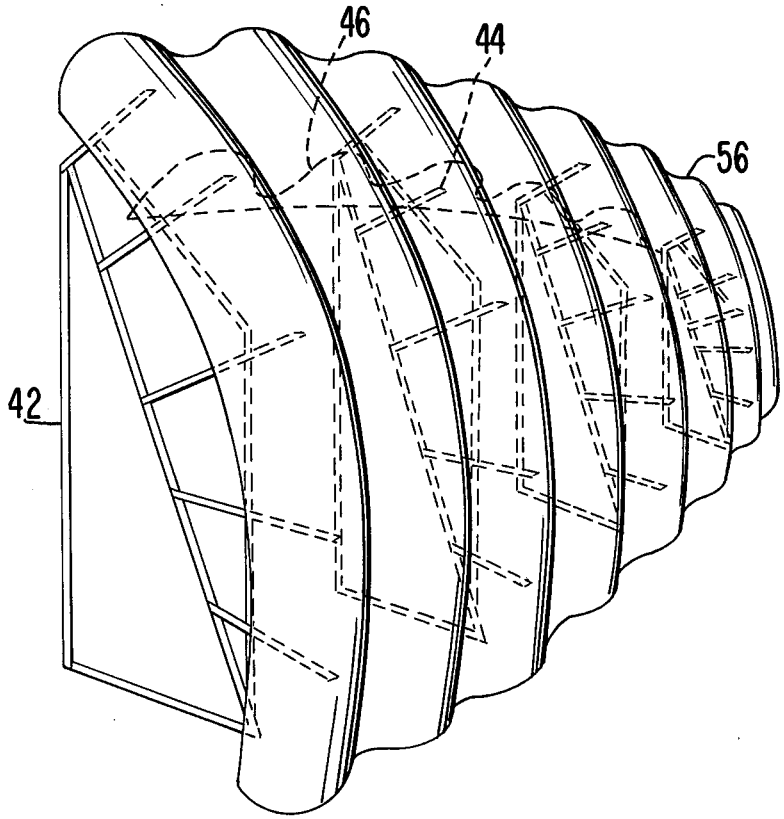
FIGS. 9 and 10 are perspective views of the plug used for fabricating the mold for use in making the embodiment of FIG. 1.
Figure 10:
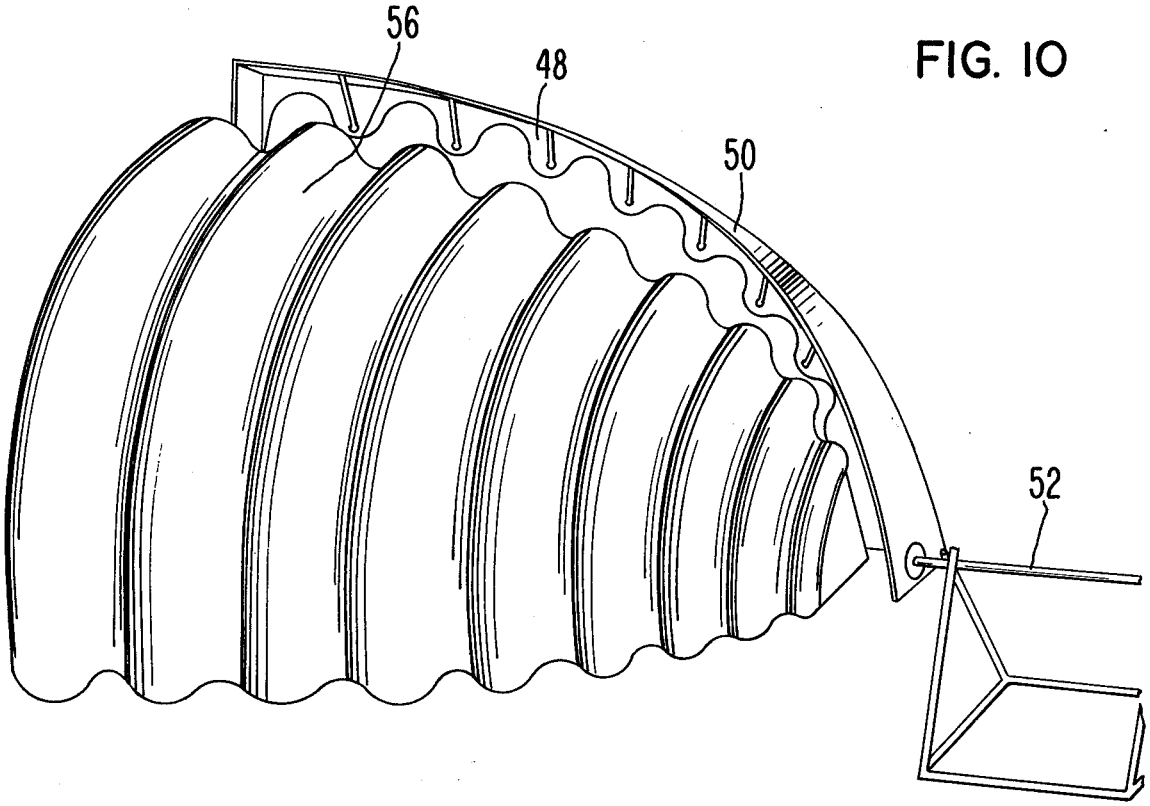
Figure 11:
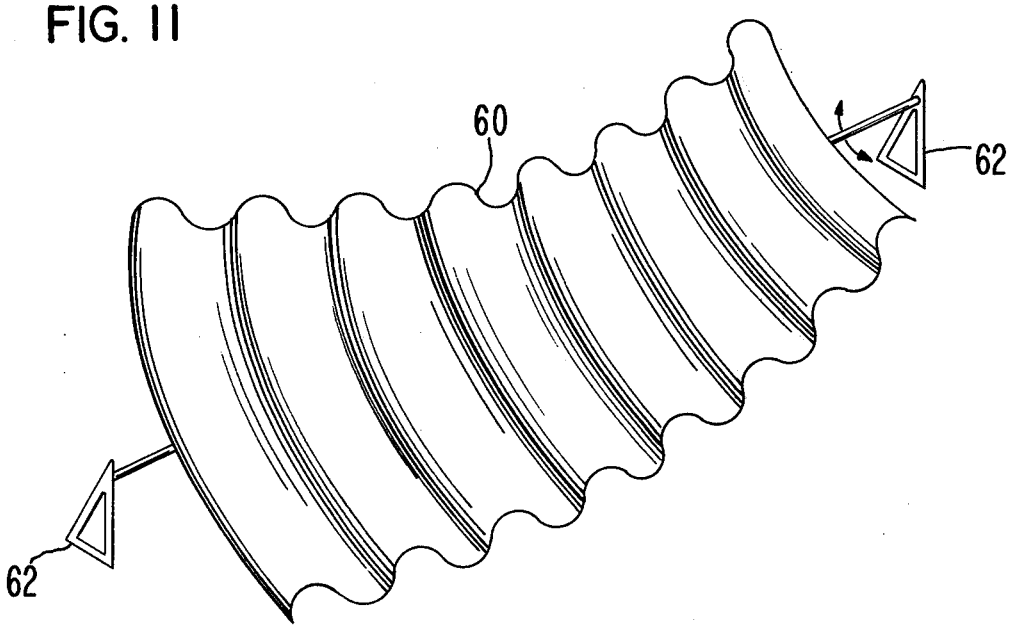
FIG. 11 is a perspective view of the mold for fabricating the sections used in making the embodiment depicted in FIG. 1.

Referring now more particularly to FIG. 5 the calculation of the convolutions for the surface 12 will be explained in greater detail. Once the inventor had conceived of the self-supporting principle of the convolutions, it was necessary to formulate a solution that would give the necessary relationship between visual rightness of form, economy of materials and structural strength. By visual rightness of form is meant that there are certain dimensional relationships which, when viewed by most persons, seem to be "right." This phenomenon has long been known to designers particularly in regard to certain relationships between the width and height of basically rectangular objects such as automobiles. The rightness of form is often an empirical derivation, such as in the present case.

It was decided that the surface should significantly modulate the effect of light. If the convolutions were too deep they would create black voids that would break up the total continuity of the form and if the convolutions were too shallow the structure would be visually anemic. Such shallow convolutions are present in such prior art devices as the Quonset hut described above.

Another disadvantage if the convolutions were too deep is that excess material would be used (both for the increased surface area and to strengthen the vertical sections between the convex and concave curves that would otherwise tend to buckle). In any case, whatever strengthening was done, the end result of deep convolutions would be a form which is likely to concertina. On the other hand, shallow convolutions would be more liable to buckle both when being pulled from the mold and around the subsequent fittings. To counter this tendency the thickness of the panels would have to be substantially increased leading to greater material expenses.

A solution that seemed right visually was finally defined by a mathematical formula. Referring to FIG. 5, since the structure 12 is elliptic in elevation, a hypothetical, semi-elliptical line 28 can be said to pass through the surface 12 from one end to the other. Each of the convolutions 14 and 16 may be thought of as semicircular in longitudinal cross-section. Each of these convolutions 14 and 16 has a separate radius which is different from the radius of any other convolution of that half of the structure, since the convolutions diminish in size taken in the direction toward the end of the structure. For convenience of description the convex convolution closest to the middle of the structure has been defined in FIG. 5 as convolution 14*a* and the concave convolution next adjacent to the convolution 14*a* is referenced 16*a*. In similar order the sequence of following convolutions are referenced 14*b* and 16*b*, 14*c* and 16*c*, etc.

The formula ultimately derived states that the diameter of the concave convolutions 16 are two-thirds of the diameters of the convex convolutions 14. The convolutions also diminish in diameter progressively by 10% as the section of the building becomes smaller. Thus the concave convolution 16*a* is two-thirds the diameter of the convex convolution 14*a* and the convex convolution 14*b* is 10% less in diameter than the convex convolution 14*a*. This series of relationships continues towards the end of the structure 12. Furthermore the centers for the semicircular curves which make up the convolutions 14 and 16 are offset from the elliptical line 28 by an arithmetically decreasing sequence of distances beginning with the convolution closest to the middle of the structure. Thus the center point 30 for the radius of the curve 14*a* is offset from the semielliptical line 28 by a distance 32. The center 34 for the semicircular curve 16*a* is offset from the semielliptical line 28 by a distance 36 which is less than the distance 32 by a predetermined amount. Similarly the center 38 for the semicircular curve 14*b* is offset from the semielliptical line 28 by a distance 40 which is less than the distance 36 by the same amount as the distance 36 is less than the distance 32.

In the embodiment actually constructed by the inventor the height of the semielliptical line 28 from what would mathematically be the base plane of the structure is 10 feet and the overall length of the building is approximately 30 feet, that is, half of the major diameter of the ellipsoid is 15 feet. The minor diameter of the ellipsoid in the plan view is 24 feet. The distance 32 is approximately three inches and is progressively reduced by 3/10 of an inch towards the end. It should be clear, however, that these distances are purely exemplary and in no way are intended as limiting upon the invention as a whole.

Referring now more particularly to FIGS. 6, 7, 8, 9, 10 and 11 the method for constructing the apparatus from which the structure 12 is molded will be described in greater detail. In order to construct the mold a braced frame 42 is constructed which generally conforms at its exterior points to the interior of the surface 12. Next, a plurality of positive plywood profiles 44 having convoluted edges 46 are spaced apart from each other in a proper relationship to define the corrugations and are mounted on the frame 42. Chicken wire or other form of temporary surface (not shown) is then attached to the exterior of the profiles 44 and roughly defines a longitudinal, half sector or gore of the ellipsoid. A metal shutter blade 48 is cut to the convolutions of the structure, backed with wood and is strengthened by a peripheral T-shaped section 50. The blade 48 is also braced diagonally to eliminate flex. The blade 48 is pivoted by means of exterior framing 52 to sweep across the contour of the surface of the model for the mold which is to be constructed. The function of the blade 48 is to screed wet plaster put on the chicken wire to the exact form required. The shutter blade 48 is counterbalanced with anchor chains 54 so that the maximum weight of the chains counterbalances the heaviest position of the shutter. As the shutter is raised the effort required to lift it becomes less and correspondingly the weight of the anchor chains is reduced link by link as they are lowered to the floor. In other embodiments a block and tackle arrangement can be used to lift the blade 48 so that it can serve as a scaffold for the workers in preparing the plaster model for the mold. In the actually constructed version two thousand pounds of plaster were spread over the chicken wire and plywood profile supported by the framework 42. The shutter blade 48 was pivoted about the inner plaster covered master form to screed the convolutions in the desired manner. The result was a single master plug 56.

The plug 56 is carefully sanded and spray lacquered again and again to give a highly polished, nonporous surface. It should be noted at this point that the shutter blade 48 is unable to rotate much more than 180° of revolution. This means that the plug 56 does not extend completely down to a hypothetical ground plane 120 which extends through the structure considerably below the hypothetical axis of revolution 116 for the structure (see FIG. 21). This creates a difficulty which will be explained in greater detail hereinafter at page 17.

In order to make the mold off of the porous plug 56 the plug 56 is waxed so as to be nonporous with a carnauba-type wax and is then spray coated with a solution of polyvinyl alcohol (PVA) which dries to a thin, water-soluble film. A resin gel coat is next sprayed over the plug 56. Thereafter the mold is made by fiberglassing over the surface of the plug 56 with a special high heat resin commonly used in the fiberglassing trade to make tooling. Once the fiberglass tooling coating has dried it is stripped from the plug 56 and constitutes the mold 60 (see FIG. 11) for the subsequently to be fabricated sections 20. The mold 60 is pivoted at its ends on a framework 62 to give easier access to its interior, generally concave surface. This interior surface of the mold is next polished and has carnauba wax applied to it. The wax surface is then coated with PVA and a resin gel coat is applied. Fiberglass is then applied over the gel coat and a resin, hardening coat is next applied. This fiberglassing procedure is standard in the industry and well known in the art and therefore is not being described in greater detail. Any of a variety of suitable resins well known to those skilled in the art in this field may be utilized. The finished section 20 is then stripped from the mold 60 and appears generally in the same shape as the plug 56 except that it is only 3/16 inch thick fiberglass and weighs only 150 to 200 pounds. There are numerous other ways of forming these sections 20, and they will be described hereinafter in greater detail.

Referring now more particularly to FIG. 12 the method for securing the structure to the surface upon which it is mounted is illustrated. As has been previously mentioned each of the elements 20 extends from the approximate middle of the structure to one of its ends. Taking the middle convolution as convolution 64, then with the next succeeding convex convolution 66 a plate 68 which is semicircular to fit the interior periphery of the convolution 66 is epoxied to the lower surface of the convolution 66 as depicted in FIG. 12. The epoxy forms a fillet 70 between the upper surface of the semicircular plate 68 and the lower edge of the convolution 66. This fillet 70 serves to cantilever the plate from the surface of the convolution 66 to avoid a direct load. The plate has a cutout portion 72. A footpad 74 is epoxied to the surface 76 upon which the structure is to stand. The footpad has a projecting threaded rod 78 which extends upwardly through the opening 72. A washer 80 is fitted over the extending rod 78. The washer 80 is larger than the opening 72 and a nut 82 is fitted onto the rod 78 above the washer 80. When the nut 82 is tightened down on the rod 78 the section 20 is firmly clamped to the surface 76 at the pad 68.

The panel section 20' depicted in FIG. 12 is referred to hereinafter as a ground panel because it is one of the four panels upon which the structure rests. The location of these ground panels 20' are better depicted in FIG. 3. After the ground panels 20' which are opposite to each other are bolted to the ground the next succeeding opposite side panels, referenced 20'' in FIG. 3, are then attached over the corresponding ground panels 20' and the top panel 20''' is added to complete one-half of the structure. This half is now self-supporting. The same procedure is repeated for the second half. The method of attaching the panels to each other will now be explained.

Referring now more particularly to FIGS. 13 and 14 each panel is provided with a plurality of small fittings 83 which hold removable cross struts 84. The struts 84 bridge or act as cords across alternate concave convolutions (as viewed from inside). The struts 84 are provided at the top of the base panels 20' in FIG. 13, and are inset from the bottom of the upper panels 20'' by an amount sufficient to allow a predetermined overlap of the upper panel 20'' over the lower panel 20'. The upper side panels or sections 20'' also have struts 84 at their upper edge to align with the struts of the top panel 20''' (not shown). The struts 84 are placed so as to be aligned with each other when the panels are properly assembled. An H-shaped block 86 having cutout portions to accommodate the struts 84 is placed between the upper and lower struts to support the weight of the upper panel 20'' on the lower panel 20'. Strapping tape 88 is then wrapped around the struts 84 which are spaced apart by the block 86 to hold them in place. It should be understood that this method of fastening the panels to each other is simply a temporary measure during construction since it does not prevent the upper panel 20'' from rotating about the lower panel 20'. In the final assembly the most suitable method of joining the sections 20 to each other is one that distributes the stress as evenly as possible, such as by adhesive bonding which results in a homogeneous shell in keeping with the structural theme. It is also possible to attach the sections to each other by bolting with large washers or riveting. However, these are more likely to raise stress points which are undesirable in the long term operation of the structure. it should be noted at this point that the panels or sections 20 when disassembled nest inside of each other for storage and easy transportation. The struts 84 also provide a handle for lifting the section during construction. If the building is to be permanently constructed these struts may later be removed from the fittings 83. The above described method of assembling the structure is illustrated in stepwise fashion in FIGS. 15, 16 and 17 which show, respectively, the fastening of one of the base panels 20' to the support surface, the attachment of one of the side panels 20'' to the base panel 20', and the fitting in place of one of the top panels 20'''.

Referring now more particularly to FIGS. 18, 19 and 20 alternative methods for forming the panels 20 will be described in greater detail. With particular reference to FIG. 18 the panels 20 may be made of fiberglass reinforced polyester (FRP) which may, in addition to simply being laid on the mold as described above, also be sprayed on the mold by means of a chopper gun process, which is well known in the industry, or it can be compression molded. In FIG. 18 a compression molding apparatus is diagrammatically depicted in which a stationary female mold 90 receives an FRP sheet (not shown) which is pressed into the mold 90 by means of a movable male mold 92 operated by a pneumatic or hydraulic ram 94.

Referring now to FIG. 19, a section 20 may be fabricated from a thermoplastic sheet 96 which is softened by heat from an overhead electrical heating element 98 and is sucked against a vacuum mold form 100 beneath the sheet. When the sheet 96 cools, the plastic will retain a memory of the mold and will have the necessary contours described above. A ram operated male mold can also be used in this process to press the softened sheet 96 firmly against the vacuum mold 100.

In still another thermoplastic method the sheet 96 is hung from a movable transport 102 suspended from an overhead track 104. The sheet 96 has previously been trailed through an oven 106 which straddles the sheet 96 and heats it up to its softening temperature. The softened sheet 96 is positioned by means of the mechanism 102 and 104 between a stationary female mold 108 and a movable male mold 110 operated by air cylinders 112 attached to a stationary frame 114. As is the usual practice the movable male mold 110 compresses the sheet 96 against the female mold 108 to cause the sheet 96 to take the desired convoluted form. Upon cooling the sheet 96 retains this shape in the usual manner. It should be apparent that numerous other well known plastic molding techniques would also be suitable for forming the sections 20.

Figure 21:
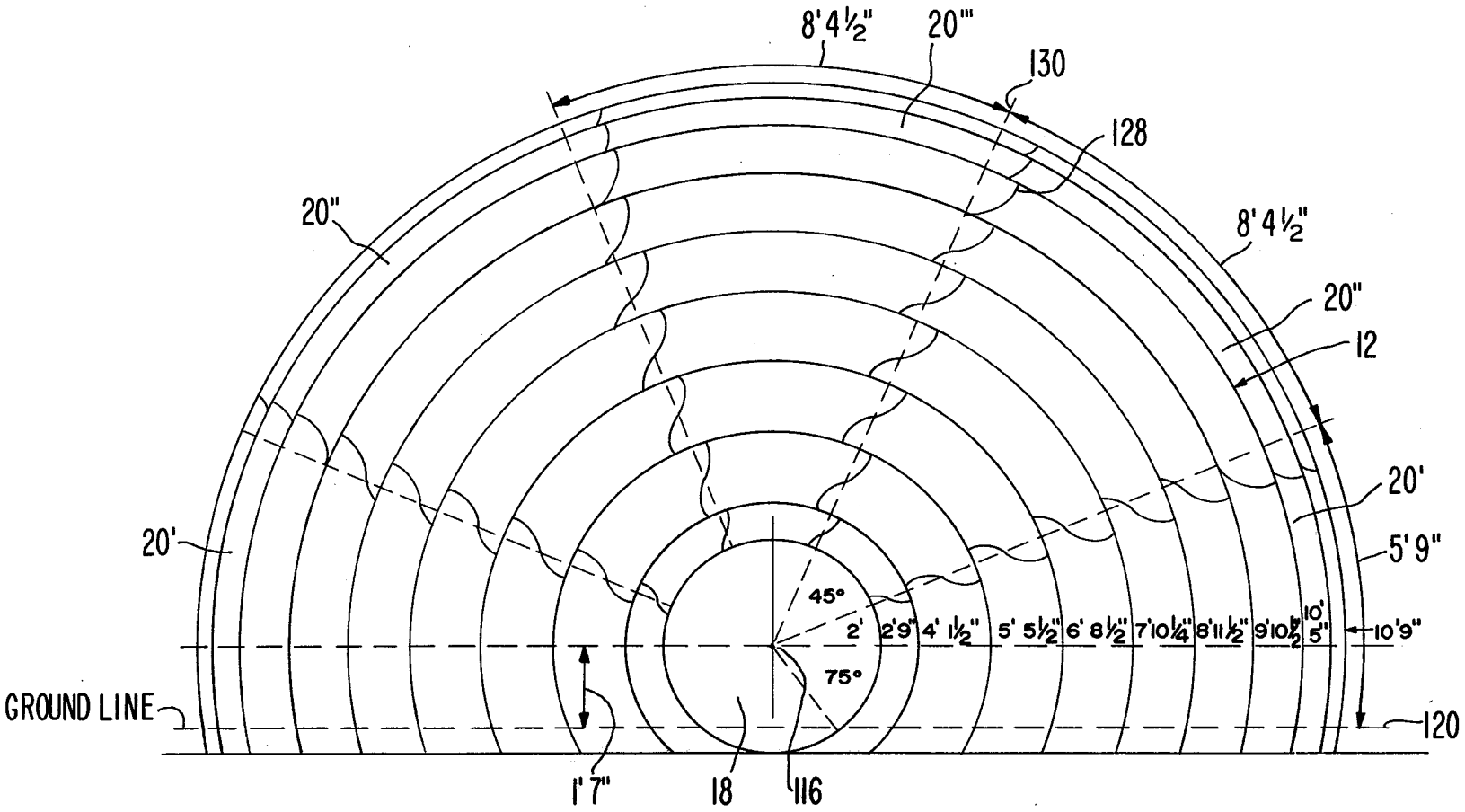
FIG. 21 is an end, diagrammatic view of a modification of the embodiment depicted in FIG. 1.
Figure 22:
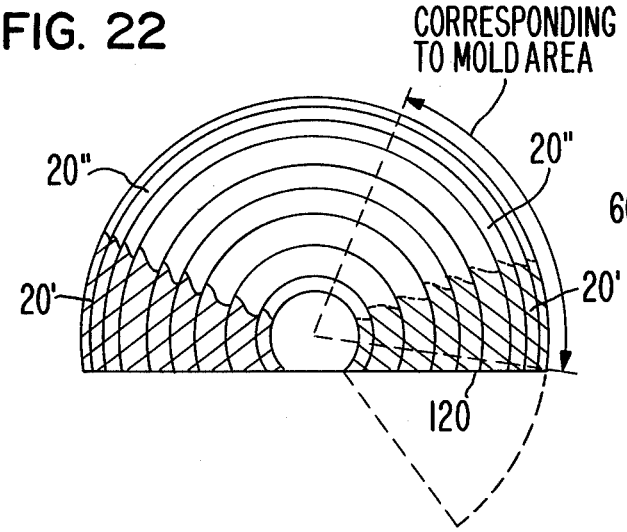
Figure 23:
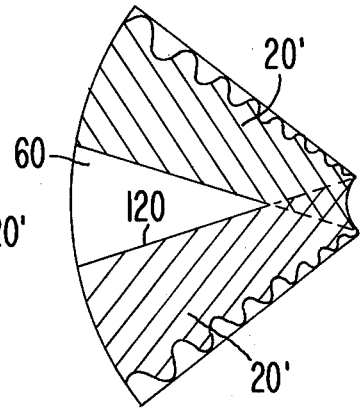

Referring now more particularly to FIG. 21 the base panels 20' extend largely below the hypothetical, longitudinal axis of rotation 116 for the elliptic structure. The mold described above does not include much of this area as it would require an almost 360° model 56 to take the mold from (see, for example, FIG. 22). For example, as viewed in FIG. 21, if the surface 12 was exactly one-half of a cylinder, as viewed from the end, then the ground line would be at line 118 and the angular extent as viewed from the end would be 180°. It is desired, however, that the lower edges of the surface 12 should continue beyond the line 118 so that a perfectly rounded end cap 18, for example, can be emplaced. This gives a more desirable aesthetic form as well as a greater standing room height within the structure. However, the missing area can be obtained by "rotating" the mold as indicated in dotted line fashion in FIG. 22 so that the top edge of the ground line 120 is drawn somewhat diagonally across the surface of the mold. This "rotation" is, of course, simply done in theory while in fact the ground line 120 is simply marked on the mold 60 from one to the other with the proper orientation as calculated by the hypothetical rotation (see FIG. 23). Similarly the other ground panel 20' may also be obtained. In FIG. 23 the shaded areas represent the ground panels 20'.

Figure 24:
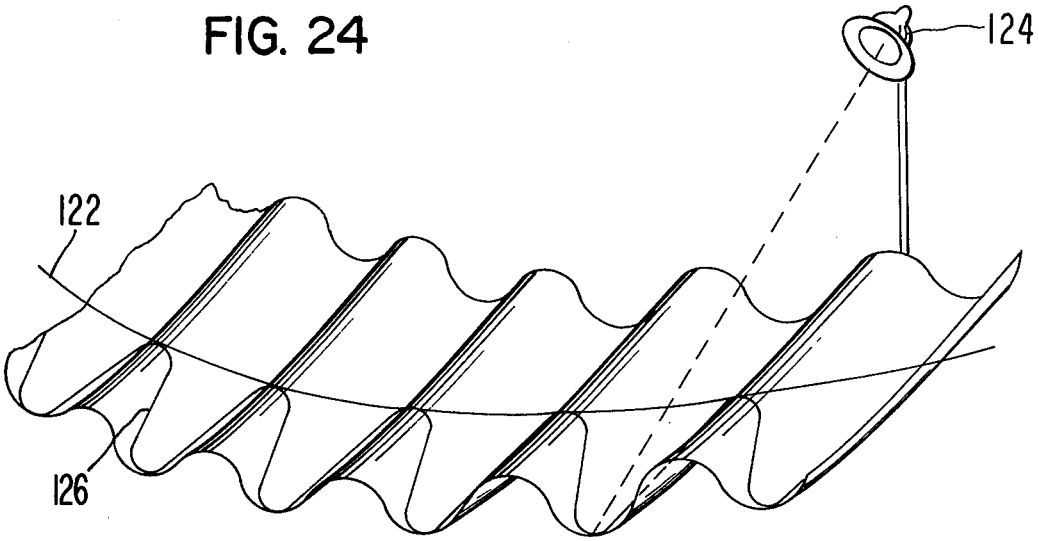

It is desirable that the overlapping joining of the panels be homogeneous with the total form of the structure as are the markings or ridges on organic forms. A straight edge would be aesthetically less suitable than a curved edge and any curves should be in relationship to the convolutions. A method to automatically ensure the desired relationship is by draping a cord, 122 as viewed in FIG. 24, so that it touches the tops of all the convolutions at the edge of the panel 20. A light 124 is used to cast a shadow of the cord a prearranged distance, which may be empirically selected, and, providing the light is lined up with the axis of revolution of each convolution in turn, a symmetrical curve 126 results that is conditioned by the convolutions and is therefore harmonious with them. When the panel 20 is cut along the shadow line 126 it has the effect of producing scalloped edges 128. The scalloped line 126 is arranged during the marking step so that when the unit is assembled the scallops 128 will be generally centered on a hypothetical elliptical line 130 which runs from one end of the structure to the other. The scallop of the largest convolution will be offset from the line 130 by a predetermined amount which in the actual embodiment constructed was 9 inches. The remaining scallops taken towards the direction of either end are offset from the hypothetical line 130 by progressively lesser amounts until the last scallop is exactly centered on the line (see FIG. 21).

Figure 25:
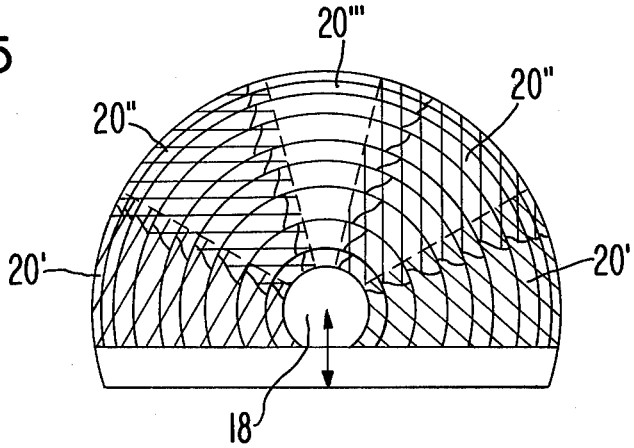

In order that all of the panels 20 should fit flush with each other to give a smoother appearance than in the embodiment actually constructed a recessed lip can be molded in as an extension to most of the panels. Referring more particularly to FIGS. 25 and 26 the recessed lip 132 is integrally molded to the interior surface of each of the panels 20 to extend beyond the scalloped edges 128. This recessed lip may be accomplished by laying into the mold a sheet 134 of ⅛ inch thick rubber which is cut to match the scalloped edge of the panel and which is flexible enough to drape into the contour of the mold 60. The mold is then fiberglassed over the edge of this sheet 134 to form the built-in lip 132. It is only necessary to have two of these rubber edge profiles 134 cut from a single sheet of rubber. It must be used one face up for one-half of the structure and inverted for the other half in order that the scallops will match up at the center. Not all of the panels 20 are provided with such recessed lips. The center panel 20''' has no recessed lip and the two upper side panels 20'' each have a recessed lip on the upper edge so that the scalloped edges of the panel 20''' overlap and fit into the lips 132 in the panels 20''. The shaded areas in FIG. 25 correspond to the overlapping portions. Similarly the scalloped lower edges of the panels 20'' do not have the recessed lip, but the upper edges of the base panels 20' have a recessed lip 132 over which the bottom scalloped edges of the panels 20'' fit into scalloped indentations in the base panels 20'. The bottom edges of the base panels 20' have a straight ground line.

Referring now more particularly to FIG. 27 a circular version 136 of this convoluted structure of the invention requires only one mold, since repetition of the one convoluted "gore section" 138 will form a complete hemispherical structure. The convolutions 140 narrow in width, i.e., taper as the gore section narrows towards its top. The gore sections are attached to the ground in the same way as the elliptical system described above in reference to FIG. 12. The gore section panels can be fastened to each other by the use of bolts and washers, rivets, etc., but a most suitable method is to construct the gore section so as to have an undercut hollow convolution of reduced diameter 142 at the edge of each section. Since the gore sections are made of a plastic, resilient material the panels will then snap firmly together by fitting one reduced convolution into the reduced convolution of the adjacent panel.

This convoluted hemispherical version 136 is easily erected and dismantled. As with the other embodiment described above, the sections nest within each other and provide easy storage and transportation. The panels may be made of continuous cast acrylic, for example, which would allow panels of 12' or more in length to be formed as single pieces. The structure would have suitable application for kiosks, booths and conservatories, etc. In some embodiments the structure may be provided with a convoluted top 144 which engages with the upper convoluted edges of the sections 138 in jigsaw puzzle fashion.

While the above described embodiments have referred to elliptical surfaces and spherical surfaces, it should be apparent that other modifications of the embodiment would include other conic surfaces of revolution, such as parabolas and the like. It is primarily the more or less vertical corrugated surface structure which is of great importance to the invention. It should also be apparent that while the mathematical ratio defined above with respect to the diameter of the concave and convex convolutions is the preferred embodiment in other less advantageous embodiments other mathematical relationships may be suitable depending upon the intended use for the structure.

Furthermore, although the invention has been described as a complete structure, in modified embodiments one or more of the sections 20 can be combined to form partially complete structures such as wind shelters or be placed against a wall to form a greenhouse, for example.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A self-supporting structure comprised of a plurality of rigid, corrugated surface convoluted sectors of a hypothetical surface of revolution rigidly attached together at their longitudinal edges, the convolutions being continuous and symmetrical about one axis of the structure and wherein the corrugated surface of the sectors comprises alternately convex and concave convolutions extending widthwise of the structure and with the concave convolutions being a constant, predetermined fraction of the diameter of the convex convolutions and the convolutions diminishing in diameter progressively by a fixed percent in the direction from the middle of the building toward its ends.

2. A self-supporting structure as recited in claim 5 wherein the surface is elliptical in plan and elevation and the center point for the curve of each convolution is offset from a hypothetical elliptical line extending from one end of the structure to the other by a predetermined, decreasing sequence of distances beginning with the convolution closest to the middle of the structure.

3. A modular, self-supporting structure comprised of a plurality of rigid, corrugated, sectors of a hypothetical surface of revolution, the sectors having alternately concave and convex convolutions and being rigidly attached together along their longitudinal edges, the convolutions running parallel to each other and perpendicular to the length of the structure, the diameter of the concave convolutions being a constant, predetermined fraction of the diameter of adjacent convex convolutions and the convolutions diminishing in diameter progressively by a fixed percent in the direction from the middle of the building toward its ends and wherein the surface is semi-elliptical in plan and elevation taken along its length and partially circular when viewed from its end, and the center point for the curve of each convolution is offset from a hypothetical elliptical line extending from one end of the structure to the other by a predetermined, decreasing sequence of distances beginning with the convolution closest to the middle of the structure.

4. A self-supporting structure as recited in claim 3 wherein the elements each extend from the lateral midline of the surface to its end.

5. A method of constructing a self-supporting structure comprising the steps of forming a plurality of rigid, corrugated sector elements of a hypothetical surface of revolution by molding alternately concave and convex convolutions with the concave convolutions being a fixed fraction of the diameter of the convex convolutions and the convolutions extending widthwise of the elements and diminishing in diameter progressively by a fixed percent in the direction from the middle of the building toward its ends, and rigidly attaching the elements to each other along their edges.

6. A method of constructing a self-supporting structure as recited in claim 5 wherein the step of molding the convolutions in each element comprises the steps of molding each convolution to be semicircular in cross-section with the center for each convolution curve being offset from a hypothetical elliptical line extending from one end of the structure to the other by an arithmetically decreasing sequence of distances beginning with the convolution closest to the middle of the structure.

* * * * *